US005105728A

United States Patent [19]

Hayase et al.

[11] Patent Number: 5,105,728

[45] Date of Patent: Apr. 21, 1992

[54] BALANCED VARIABLE-DISPLACEMENT COMPRESSOR

[75] Inventors: Isao Hayase, Katsuta; Yasushi Muramoto, Tsuchiura; Kenji Tojo, Ibaraki; Kunihiko Takao, Tsuchiura; Masaru Ito, Katsuta; Atsuo Kishi, Katsuta; Yukio Takahashi, Katsuta; Toshio Sudo, Katsuta; Takashi Yokoyama, Katsuta, all of Japan

[73] Assignees: Hitachi, Ltd., Tokyo; Hitachi Automotive Engineering Co., Ltd., Ibaraki, both of Japan

[21] Appl. No.: 614,638

[22] Filed: Nov. 16, 1990

[30] Foreign Application Priority Data

Nov. 17, 1989 [JP] Japan ..... 1-297326

[51] Int. Cl.[5] ..... F01B 3/00

[52] U.S. Cl. ..... 92/71; 92/12.2; 417/222 R

[58] Field of Search ..... 92/12.2, 71; 417/222, 417/222 S, 270; 91/506

[56] References Cited

U.S. PATENT DOCUMENTS 4,030,404 6/1977 Meijer ..... 92/12.2
4,061,443 12/1977 Black et al. ..... 92/12.2
4,105,370 8/1978 Brucken et al. ..... 92/12.2
4,294,139 10/1981 Bex et al. ..... 92/12.2
4,428,718 1/1984 Skinner .
4,533,299 8/1985 Swain et al. ..... 417/222 S
4,815,358 3/1989 Smith ..... 417/222 S
4,836,090 6/1989 Smith ..... 92/12.2
4,884,952 12/1989 Kawamaru et al. ..... 417/222

FOREIGN PATENT DOCUMENTS 58-4195 1/1983 Japan .

*Primary Examiner*—Edward K. Look
*Assistant Examiner*—Thomas Denion
*Attorney, Agent, or Firm*—Antonelli, Terry, Stout & Kraus

[57] ABSTRACT

A variable-displacement compressor includes a wobble member for driving a pistons, and a rotation member for wobbling the wobbling member, a first support portion for supporting a wobbling member in such a manner that the angle of wobbling of the wobbling member is variable, and a second support portion for supporting said rotation member in such a manner that the angle of tilt of said rotation member relative to a main shaft is variable. With this construction, unbalanced inertia forces can be reduced greatly, thereby providing the variable-displacement compressor which produces less vibrations and noises.

10 Claims, 8 Drawing Sheets

BALANCED VARIABLE-DISPLACEMENT COMPRESSOR

BACKGROUND OF THE INVENTION

This invention relates generally to a compressor and more particularly to a variable-displacement wobble plate compressor suited for a coolant compressor for an air conditioner for an automobile.

A conventional variable-displacement wobble plate compressor as disclosed in U.S. Pat. No. 4,428,718 includes a swash plate which has a swash plate portion and a boss portion rotatably supporting a piston support wobble plate, with the boss portion being formed integrally with the swash plate portion. The swash plate is tiltably supported at its boss portion by a sole sleeve slidable along a drive shaft. Particularly, in this construction, the swash plate portion is deviated from the center or axis of tilting of the swash plate relative to the sleeve.

In the above conventional construction, as compared with a tilting moment of the swash plate plane due to an inertia couple produced by a reciprocal movement of each piston, a tilting moment of the swash plate plane due to a centrifugal force produced by the rotation of the swash plate portion and acting in an opposite direction is smaller. This results in a problem that the unbalanced tilting moment due to the inertia force remains.

The above unbalanced tilting moment due to the inertia force increases in proportion to the square of the rotation and the direction of this tilting moment is such that increases the tilting angle of the swash plate. Therefore, a problem arises in that, during a high-speed operation, it is difficult to effect the control in such a direction as to decrease the angle of the swash plate.

Further, since the swash plate portion is deviates from the axis of rotation of the swash plate relative to the sleeve as described above, its center of gravity deviates from the axis of rotation of the drive shaft, depending on the angle of tilt of the swash plate plane relative to the drive shaft, so that the resultant force of the centrifugal forces acting on the various regions of the swash plate portion will not become zero. This unbalanced centrifugal force and the above-mentioned unbalanced moment are transmitted to the exterior of the compressor to thereby cause vibrations.

Particularly, the above unbalanced inertia force varies in magnitude in accordance with the variation of the tilt angle of the swash plate effected during the displacement control of the compressor, and therefore even if a balance mass is fixed to the drive shaft, it has been impossible to always achieve a balance with respect to all the tilt angles of the swash plate.

SUMMARY OF THE INVENTION

It is an object of this invention to provide a variable-displacement wobble plate-type compressor which can positively effect a displacement control even during a high-speed operation, and produces less vibration.

According to the present invention, for the above end, there is provided a variable-displacement compressor comprising pistons; a swingable member for driving the piston wobble plate; a rotation member for swinging the swingable member; a first support portion for supporting the swingable member in such a manner that the angle of swinging of the swingable member is variable; and a second support portion for supporting the rotation member in such a manner that the angle of tilt of the rotation member relative to a main shaft is variable.

By the above construction, the distance of the center of gravity of the mass (whose tilt angle relative to a drive shaft is variable) from the axis of the drive shaft, as well as the amount of change of this distance in accordance with the displacement control, is very small. Therefore, the centrifugal force acting thereon, as well as the amount of change of the centrifugal force due to the variation in the tilt angle of a swash plate, is small.

Because of the reduction of the centrifugal force acting on the above gravity center, the magnitude of the moment developing in a direction to increase the tilt angle of the above mass is decreased. Therefore, the magnitude of the moment developing in a direction to decrease the tilt angle due to the centrifugal force acting on each portion of the mass is increased. Further, the center of amount of deviation of the gravity from the drive shaft, as well as its variation relative to the tilt angle of the swash plate, is very small. Therefore, by increasing the mass whose tilt angle relative to the drive shaft is variable, the moment developing in a direction to decrease the tilt angle of the swash plate can be increased without considerably increasing the centrifugal force and the amount of variation thereof relative to the tilt angle of the swash plate. Therefore, this moment can be easily balanced with the tilting moment which develops in a direction to increase the tilt angle of the swash plate during the reciprocating movement of each piston.

As a result, with respect to all the tilt angles of the swash plate, vibrations and noises caused by the unbalanced inertia forces can be reduced, thereby improving the reliability of the displacement control during a high-speed operation.

DETAILED DESCRIPTION OF THE PREFERRED EMBODIMENTS

Figure 1:
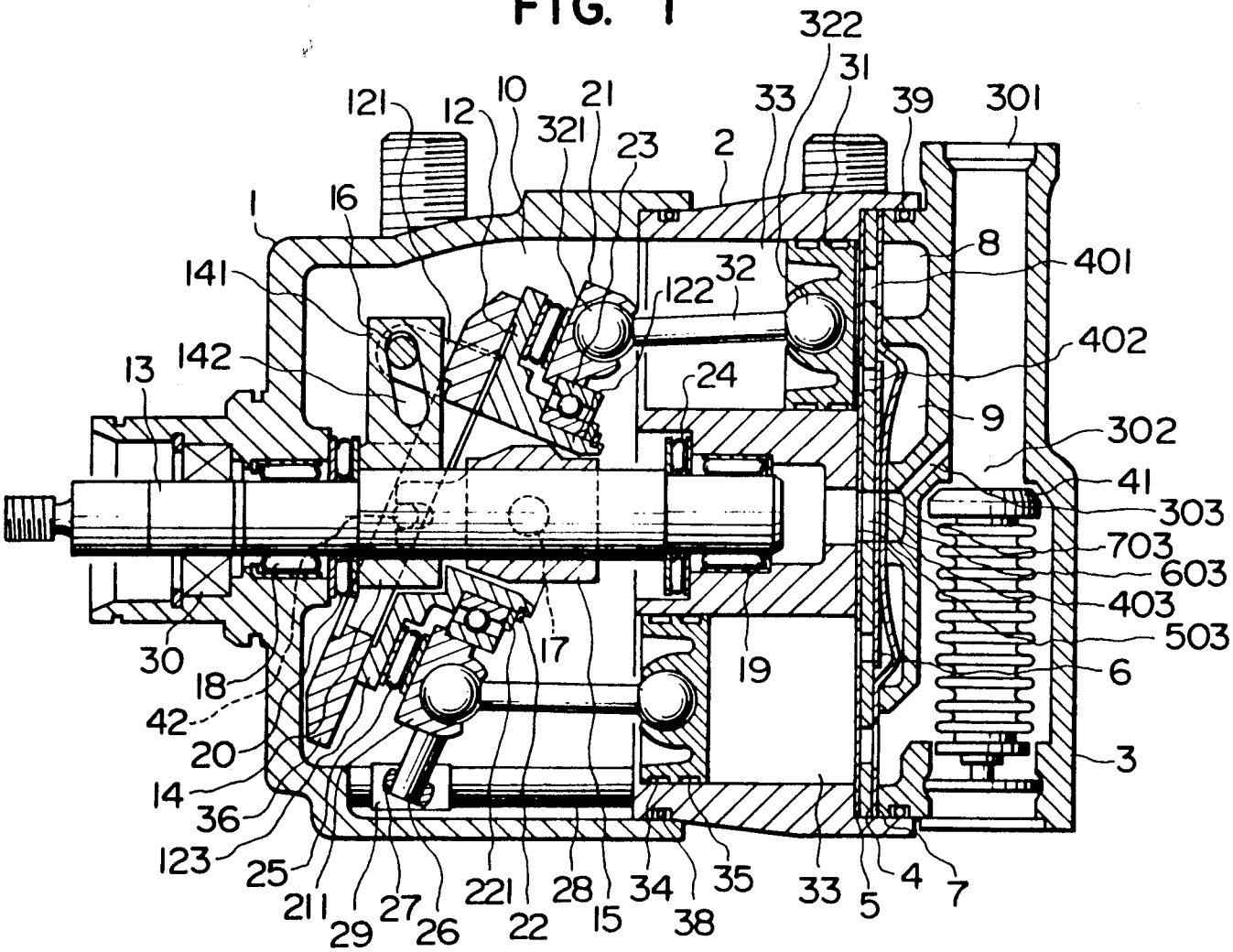
FIG. 1 is a vertical cross-sectional view of a first embodiment of the invention in its maximum displacement condition.

In a first embodiment of the present invention shown in FIGS. 1-4, a front housing 1 is fixedly mounted on one end of a cylinder block 2 of a cylindrical shape to form a swash plate chamber 10. A main shaft 13 is rotatably supported at the central portion of the housing 1 through a radial needle roller bearing 18. The cylinder block 2 has a plurality of cylinders 33 arranged circumferentially around the main shaft 13, the axes of the cylinders 33 being parallel to the axis of the main shaft 13. The main shaft 13 is disposed substantially on the centerline or axis of the cylinder block 2, and is rotatably supported by the radial needle roller bearings 18 provided at the central portion of the front housing 1 and a radial needle roller bearing 19 provided at the central portion of the cylinder block 2. A drive plate 14 is fixedly mounted on the main shaft 13 by press-fitting, plastic connection, or the like. A cam groove 142 is formed in the drive plate 14, and a pivot pin 16 fitted in an ear portion 121 of the swash plate is movably received in the cam groove 142. An ear portion 141 of the drive plate 14 having the cam groove 142, is disposed in contact with the swash plate ear portion 121 at their side surfaces.

With this arrangement, when the drive plate 14 rotates upon rotation of the main shaft 13, the rotational force is transmitted from the ear portion 141 of the drive plate 14 to the swash plate ear portion 121, so that a swash plate 12 is rotated. A sleeve 15 is mounted on the main shaft 13 for sliding movement along the axis of the main shaft 13, and the sleeve 15 is connected to the swash plate 12 by sleeve pins 17 in such a manner that the swash plate 12 is rotatable relative to the sleeve 15 about the sleeve pins 17. Therefore, when the main shaft 13 .rotates, the drive plate 14, the swash plate 12 and the sleeve 15 are all rotated.

A boss portion 122 projects at the central portion of the swash plate or first rotation member 12, and a piston support or wobble member 21 is mounted on the boss portion 122 through a ball bearing 23 in such a manner that the piston support 21 is rotatable about the axis of the boss portion 122. The ball bearing 23 is fixed to the boss portion 122 of the swash plate 12 by a spacer 221 and a retainer ring 22 so as not to be disengaged from the boss portion 122.

The movement of the piston support 21 relative to the ball bearing 23 in a right-hand direction (FIGS. 1 and 2) is prevented by a projecting portion 211 formed on the piston support 21, and also the movement of the piston support 21 in a left-hand direction (FIGS. 1 and 2) is prevented by a thrust bearing 25 interposed between the piston support 21 and the swash plate 12. Thus, the piston support 21 is always kept parallel to the swash plate surface. A support pin 26 is fixedly secured to the lower side of piston support 21 by press-fitting, threading, plastic connection or the like, the support pin 26 extending radially of the piston support 21. A slide ball 27 and a pair of semi-cylindrical shoes 29 each having a semi-spherical surface in contact with the slide ball 27 are rotatably and slidably mounted on the support pin 26. The slide shoes 29 are reciprocally movable along an axial groove 28 formed in the inner peripheral surface of the front housing 1, so as to prevent the piston support 21 from rotation about its axis, thus preventing the piston support 21 from rotating together with the main shaft 13. A plurality of connecting rods 32 each having balls 321 and 322 respectively at opposite ends thereof are connected at their one ends to the piston support 21 in such a manner that the piston support 21 is rotatable about the center of each ball 321. The other ends of the connecting rods 32 are connected respectively to pistons 31 in such a manner that each piston 31 is rotatable about the center of the ball 322.

The plurality of pistons 31 are received respectively in the cylinders 33 formed in the cylinder block 2. Piston rings 34 and 35 are mounted on each piston 31. An intake valve plate 5, a cylinder head 4, an exhaust valve plate 6, a packing 7 and a rear cover are mounted on the cylinder block 2. The cylinder block 2, to which the front housing 1 enclosing the drive plate 14, the swash plate 12, the piston support 21 and etc., or integrally connected, is fixedly secured to the rear cover 3 by bolts or the like (not shown). An airtight seal at the gap between the front housing and the cylinder block 2 is formed by an O-ring 38, and an airtight seal at the gap between the rear cover and the cylinder block 2 is formed by an O-ring 39. The cylinder head 4 has intake ports 401 and exhaust ports 402 corresponding respectively to the cylinders 33, and each intake port 401 and each exhaust port 402 are communicated with an intake chamber 8 and an exhaust chamber 9, respectively. An intake opening 301 and an exhaust opening (not shown) are formed in the rear cover 3, and a control valve 41 is mounted within an intake passage 302 and is disposed between the intake opening 301 and the intake chamber 8. The upstream side of the control valve 41 is communicated with the swash plate chamber 10 in the front housing 1 via communication passages 303, 703, 603, 403 and 503 formed respectively in the central portions of the rear cover 3, the packing 7, the exhaust valve 6, the cylinder head 4 and the intake valve 5. The downstream side of the control valve 41 is communicated with the intake chamber 8. The inner peripheral surface of the cam groove 142 formed in the drive plate 14 is in the shape of a closed loop or curve, and is of such a design that even if when the pivot pin 16 moves along the cam groove 142, the positions of the top dead centers of the pistons 31 are not varied.

In the above construction, when the main shaft 13 of the compressor is driven by an engine (not shown), the drive plate 14 and the swash plate 12 are rotated, so that the piston support 21 is swingingly moved relative to the axis of rotation of the main shaft 13. As a result the pistons reciprocate, a coolant returned from a refrigerating cycle (not shown) flows into the intake opening 301, and is controlled or reduced to a proper pressure by the control valve 41, and the coolant is introduced into the intake chamber 8 formed in the rear cover 3, with a proper control pressure differential being created between the upstream side of the control valve 41 (hence the swash plate chamber 10) and the downstream side of the control valve 41. Then, the coolant flows into the cylinders 33 via the intake ports 401 in the cylinder head 4 and the intake valve plate 5, thus completing the intake step. The coolant compressed by the pistons 31 is fed to the exhaust chamber 9, formed in the rear cover 3, via the exhaust ports 402 in the cylinder head 4 and the exhaust valve plate 6, and then is fed to the refrigerating cycle (not shown) via the exhaust opening (not shown). The displacement control is effected in the following manner. The pressure differential between the intake chamber 8 and the swash plate chamber 10 (that is, between the opposite sides of each piston 31) is adjusted by the control valve 41 so as to change the acting position and magnitude of the resultant force of the forces applied from the pistons 31 to the piston support 21 via the connecting rods 32, thereby controlling the tilting moment of the swash plate 12, thus effecting the displacement control.

The construction described above is similar to that of a conventional variable-displacement wobble plate-type compressor; however, in this embodiment, particularly, a balance weight or second rotation member 36 is provided between the swash plate 12 and the drive plate 14.

Figure 2:
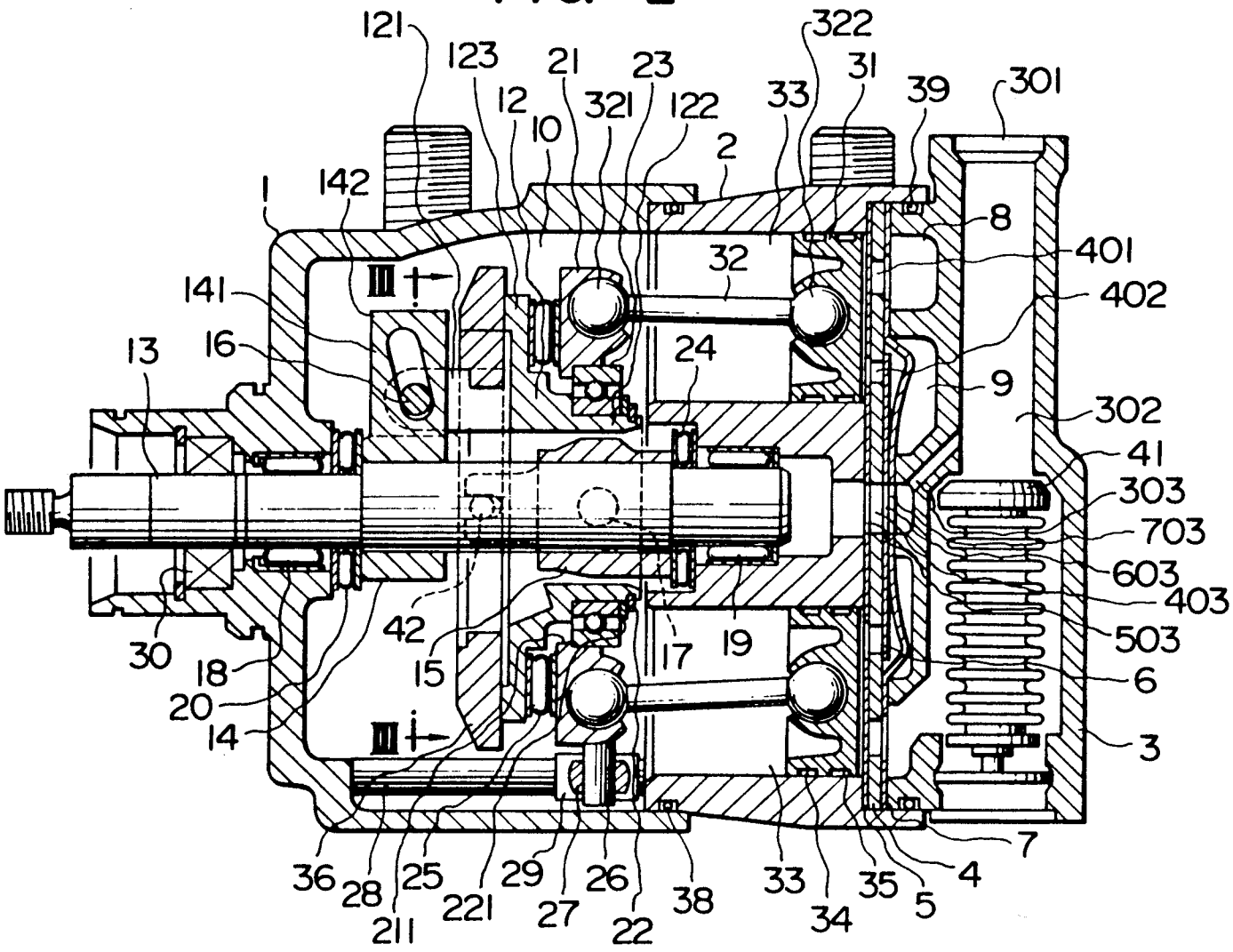
FIG. 2 is a view similar to FIG. 1, but showing the minimum displacement condition.
Figure 3:
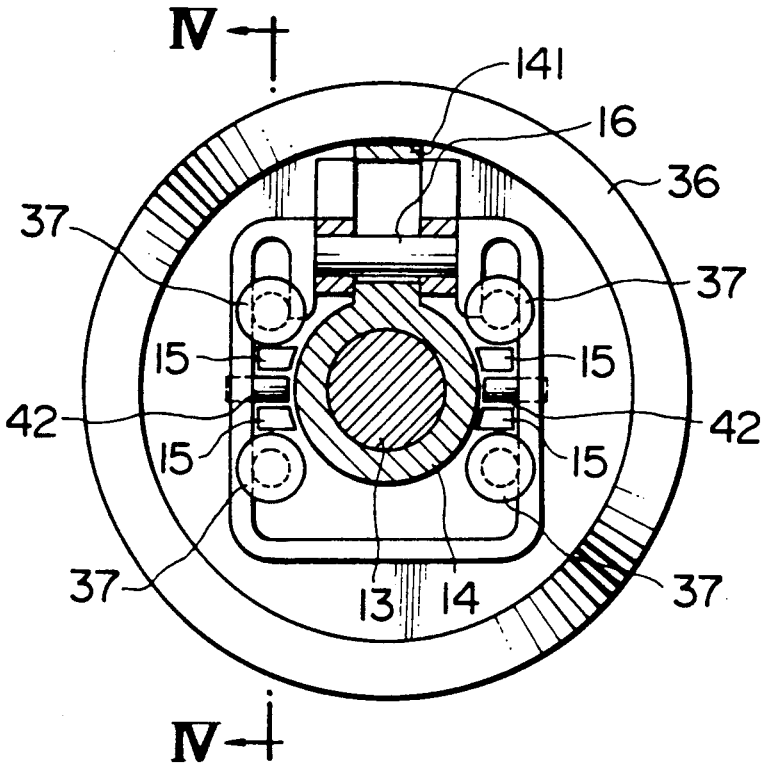
FIG. 3 is a cross-sectional view taken along the line III—III of FIG. 2.
Figure 4:
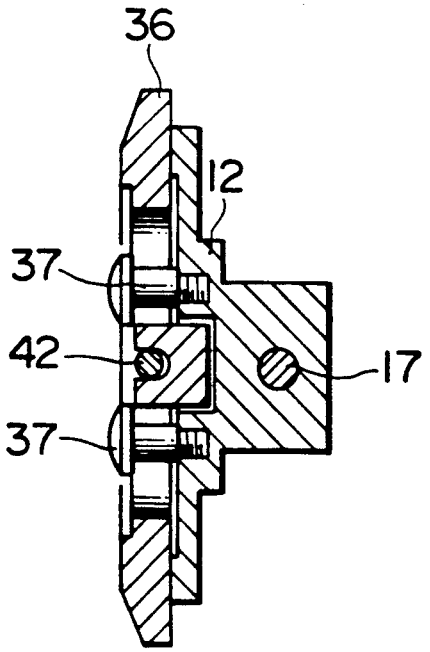
FIG. 4 is a cross-sectional view taken along the line IV—IV of FIG. 3.

As shown in FIGS. 3 and 4, the balance weight 36 is attached to the swash plate 12 by guide pins 37, and can be tilted together with the swash plate 12 in the same direction as the direction of tilt of the swash plate 12, and is slidable relative to the swash plate 12 in upward and downward directions (FIGS. 2 to 4). Balance weight tilt-supporting pins 42 are fixedly secured to the central portion of the balance weight 36, and the tilt-supporting pins 42 are slidable relative to the sleeve 15 along the axis of the main shaft 13. In the above construction, as can be appreciated from a comparison between FIGS. 1 and 2, when the angle of tilt of the swash plate 12 relative to the main shaft 13 is changed, the balance weight 36 slides relative to the swash plate 12 and the sleeve 15, so that the angle of tilt of the balance weight 36 is changed in synchronism with the change of the angle of tilt of the swash plate 12. At this time, the tilting center portion (i.e., gravity center portion) of the balance weight 36 is always kept on the axis of rotation of the main shaft 13.

The main compressor mechanisms of this embodiment are the same as conventional proven compressor mechanisms, and therefore are reliable in operation. Additionally, in this embodiment, due to the balance weight 36 having its center of gravity always disposed on the axis of rotation of the main shaft 13, an inertia couple can be produced without producing any new unbalanced centrifugal force, so that the inertia couple due to the reciprocating masses such as the pistons 31, can be canceled. Further, by doing so, it is not necessary to increase the mass of a swash plate portion 123 of the swash plate 12 in order to cancel the inertia force due to the reciprocating mass, and therefore the swash plate 12 can be reduced in weight, and the magnitude of the centrifugal force acting on the gravity center of the swash plate 12, as well as the amount of variation thereof relative to the angle of tilt of the swash plate, is reduced.

In the embodiment of FIGS. 5-9, the swash plate or second rotation member 12*a* is separate from a rotation-supporting or first rotation member 43 which supports a piston support or wobble member 21*a* via a radial bearing 53 in such a manner that the piston support 21*a* is rotatable about the axis of the rotation-supporting member 43. The swash plate 12*a* is connected to a first sleeve 46 by first sleeve pins 44 so that the swash plate 12*a* can be rotated about the first sleeve pins 44. The rotation-supporting member 43 is secured to a second sleeve 47 by second sleeve pins 45 so that the rotation-supporting member 43 can be rotated about the second sleeve pins 45. The first sleeve 46 is mounted on a main shaft 13*a* for sliding movement relative thereto along the axis of the main shaft 13*a*. The second sleeve 47 is mounted on the first sleeve 46 for sliding movement relative thereto along the axis of the main shaft 13*a*.

A preload spring 48 acts between the first sleeve 46 and the second sleeve 47. The preload spring 48 cooperates with a preload adjusting nut 49 and a lock nut 50 to apply a preload normally acting in such a direction so as to move the second sleeve 47 toward one end of the first sleeve 46 on which the swash plate 12*a* is mounted.

The preload of the preload spring 48 urges the piston support 21*a* against the swash plate 12*a* via the second sleeve pins 45, the rotation-supporting member 43 and a thrust bearing 51, thereby preventing the piston support 21*a* from moving away from the swash plate 12*a*.

A thrust bearing 52 is interposed between the piston support 21*a* and the swash plate 12*a* so as to bear a thrust load between the two. One race 521 of the thrust bearing 52 disposed close to the piston support 21*a*, as well as needle-and-retainer portions 522, is movable together with the piston support 21*a* through a projection 211*a* formed on the piston support 21*a*. The other race 523 of the thrust bearing 52 is fixedly mounted on the swash plate 12*a* so as to move together therewith. Namely, as the angle of tilt of the swash plate varies between the condition of FIG. 5 and the condition of FIG. 6 in accordance with the displacement control, the rolling surface of each needle of the thrust bearing 52 moves along the race 523 radially thereof.

The distance of movement of the above rolling surface is expressed by the following formula:

$$\delta = lp \times \{\tan(\alpha max) - \tan(\alpha min)\} \quad (1)$$

where lp represents displacement (constant value) of the center of the first sleeve pin 44 and the center of the second sleeve pin 45 from each other in a direction perpendicular to the swash plate plane, $\alpha max$ represents the maximum angle of tilt of the swash plate, and $\alpha min$ represents the minimum angle of tilt of the swash plate.

Figure 5:
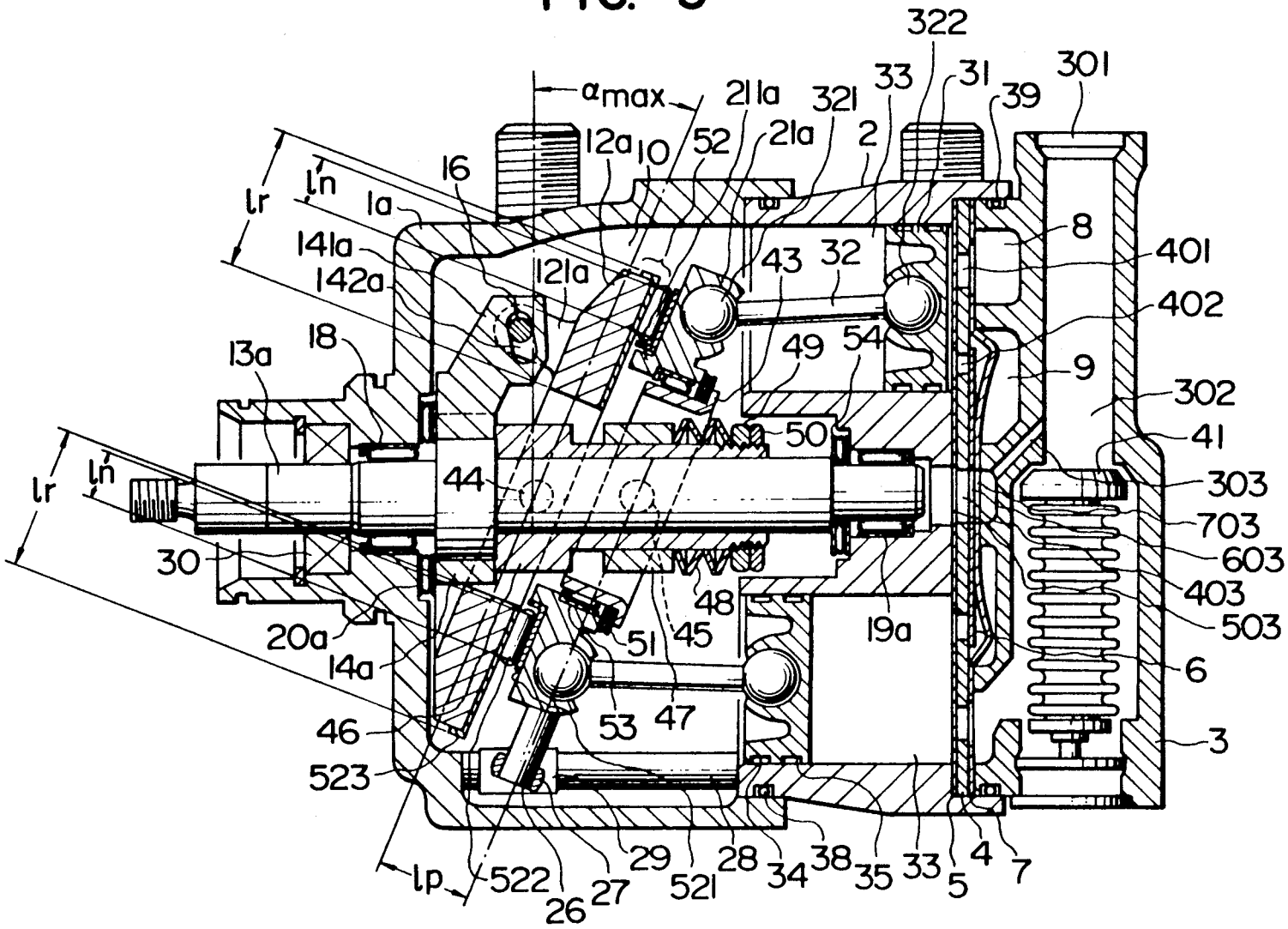
FIG. 5 is a vertical cross-sectional view of a second embodiment of the invention in its maximum displacement condition.
Figure 6:
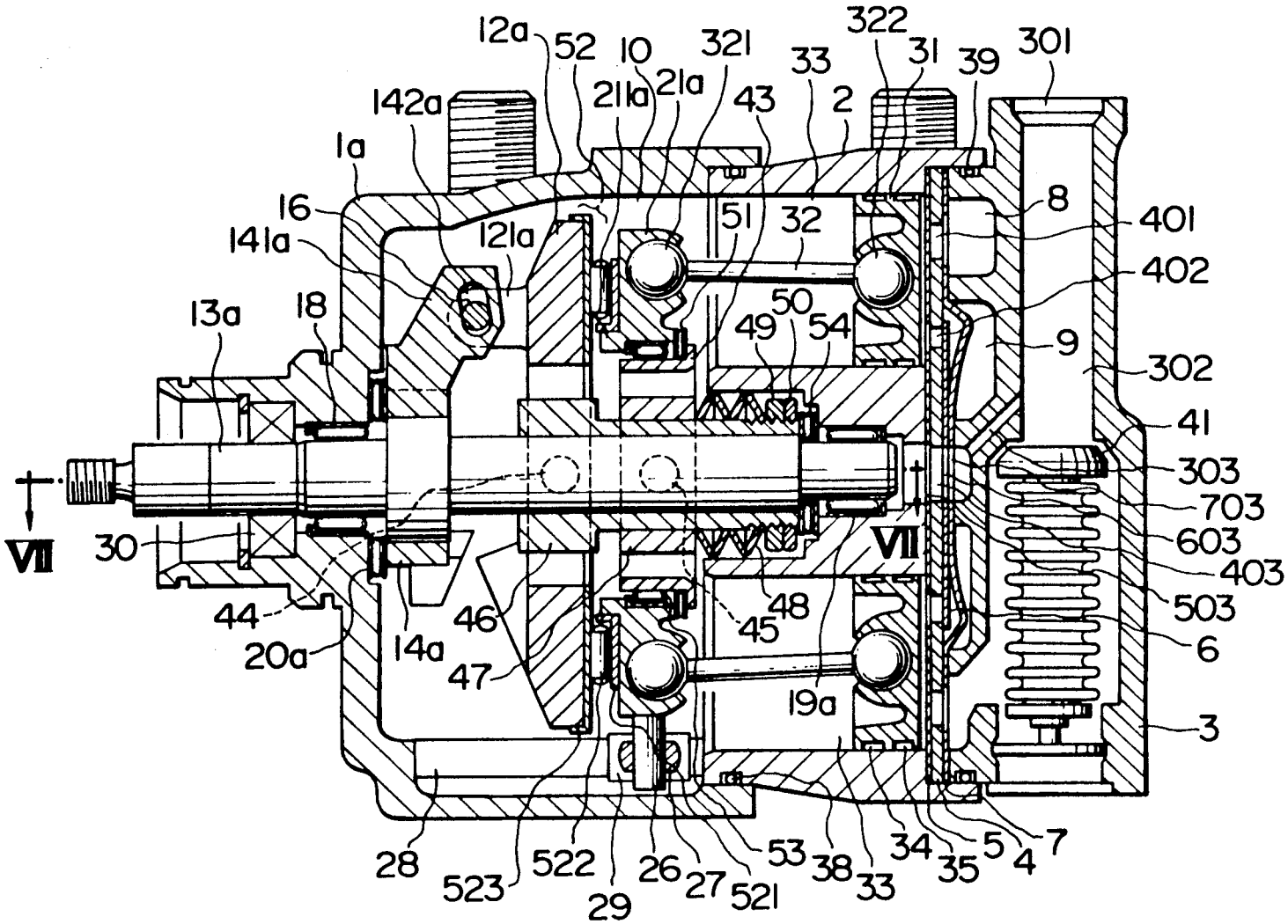
FIG. 6 is a view similar to FIG. 5, but showing the minimum displacement condition.
Figure 7:
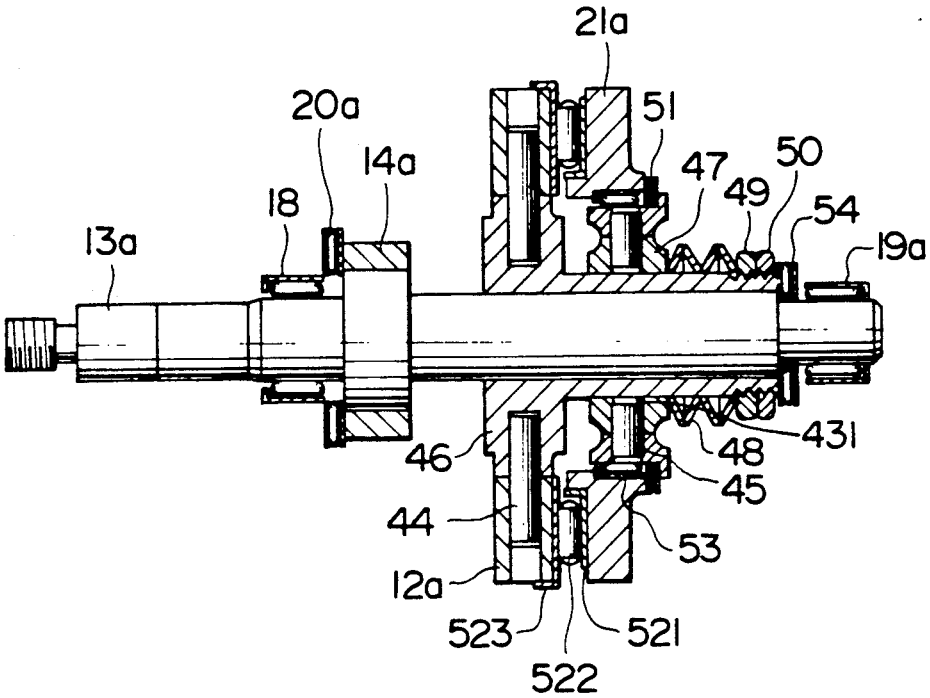
FIG. 7 is a cross-sectional view taken along the line VII—VII of FIG. 6.

Therefore, if the needle rolling width is represented by (n, the width lr of at least a cross section of the race 523 of the thrust bearing 52 in FIGS. 5 and 6 is so determined as to satisfy the following formula:

$$lr \geqq ln + lp \times \{\tan(\alpha max) - \tan(\alpha min)\} \quad (2)$$

The swash plate 12*a* has an ear portion 121*a* as in the first embodiment, and a side surface of the ear portion 121*a* is in contact with a side surface of an ear portion 141*a* of a drive plate 14*a* fixedly secured to the main shaft 13*a*. With this arrangement, a rotational force is transmitted from the main shaft 13*a* to the swash plate 12*a*. The ear portion 121*a* of the swash plate 12*a* is movable along a cam groove 142*a* formed in the drive plate 14*a*, through a pivot pin 16. The inner peripheral surface of the cam groove 142 is in the shape of such a closed loop or curve that the position of the dead center of each piston 31 will not be changed when the ear portion 121*a* moves along the cam groove 142*a*.

Figure 8:
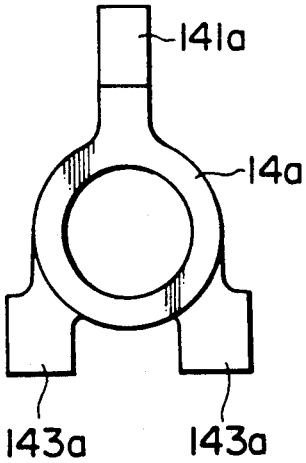
FIGS. 8 to 10 are views illustrative of a drive plate of the second embodiment.
Figure 9:
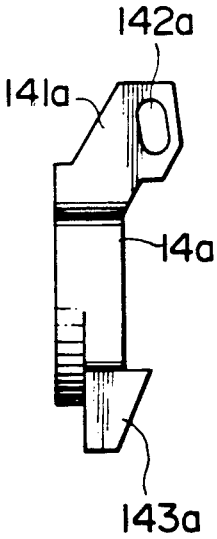
Figure 10:
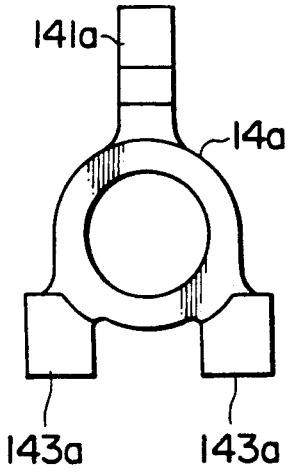

In this embodiment, balance weight portions 143*a* are formed on one end of the drive plate 14*a* remote from the ear portion 141*a*, as shown in FIGS. 8 to 10, and the center of gravity of the drive plate 14*a* is disposed substantially on the axis of rotation of the main shaft 13*a*.

Figure 11:
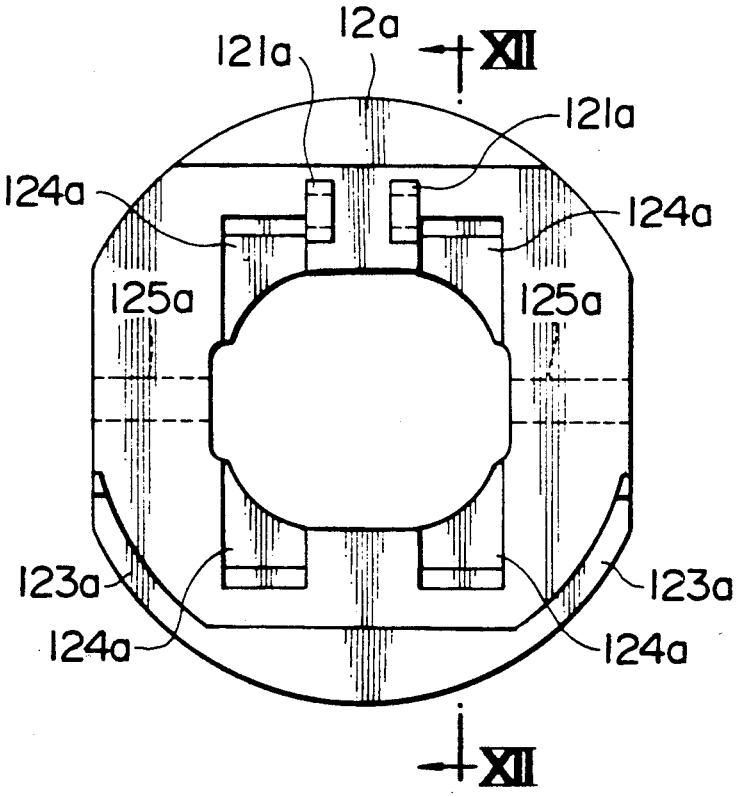
FIGS. 11 and 12 are views illustrative of the shape of a swash plate of the second embodiment.
Figure 12:
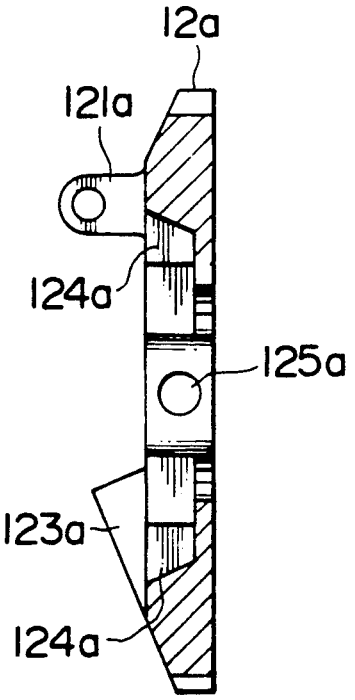

As shown in FIGS. 11 and 12, a balance weight portion 123*a* is formed on the swash plate 12*a* in order to provide a balance with respect to the ear portion 121*a*. A pair of relief portions 124*a* for the balance weight portions 143*a* of the drive plate 14*a* are formed in the swash plate 12*a* on one side portion thereof, and another pair of similar relief portions 124*a* are also formed in the swash plate 12*a* on the opposite side portion in order to provide a balance with respect to the first-mentioned relief portions 124*a*. With this construction, the center of gravity of the entire swash plate 12*a* is disposed substantially on the axes of insertion holes 125*a* for the first sleeve pins 44, with the insertion holes 125*a* being formed at the central portion of the swash plate 12*a*.

Insertion holes 431 formed in the rotation-supporting member 43 and receiving the second sleeve pins 45 are positioned substantially in registry with the center of gravity of the combination of the piston support 21*a*, ball portions 321 on one ends of connecting rods, the rotation-supporting member 43, those portions of the thrust bearing 52 movable together with the piston support 21*a*, the thrust bearing 51 and the radial bearing 53.

The other construction and the operation principle are similar to those of the first embodiment.

In this embodiment, regardless of the variation in the angle of tilt of the swash plate, the center of gravity of almost all moving parts is disposed on the axis of rotation of the main shaft 13*a*, and therefore unbalanced centrifugal force hardly develops. Particularly, since the swash plate 12*a* can alone increase the mass without producing a centrifugal force, it can easily produce an inertia couple sufficiently commensurate with the inertia couple due to the reciprocating masses such as the pistons 31. Therefore, the centrifugal forces as well as the force couples can be substantially completely balanced at all the angles of tilt of the swash plate.

Figure 13:
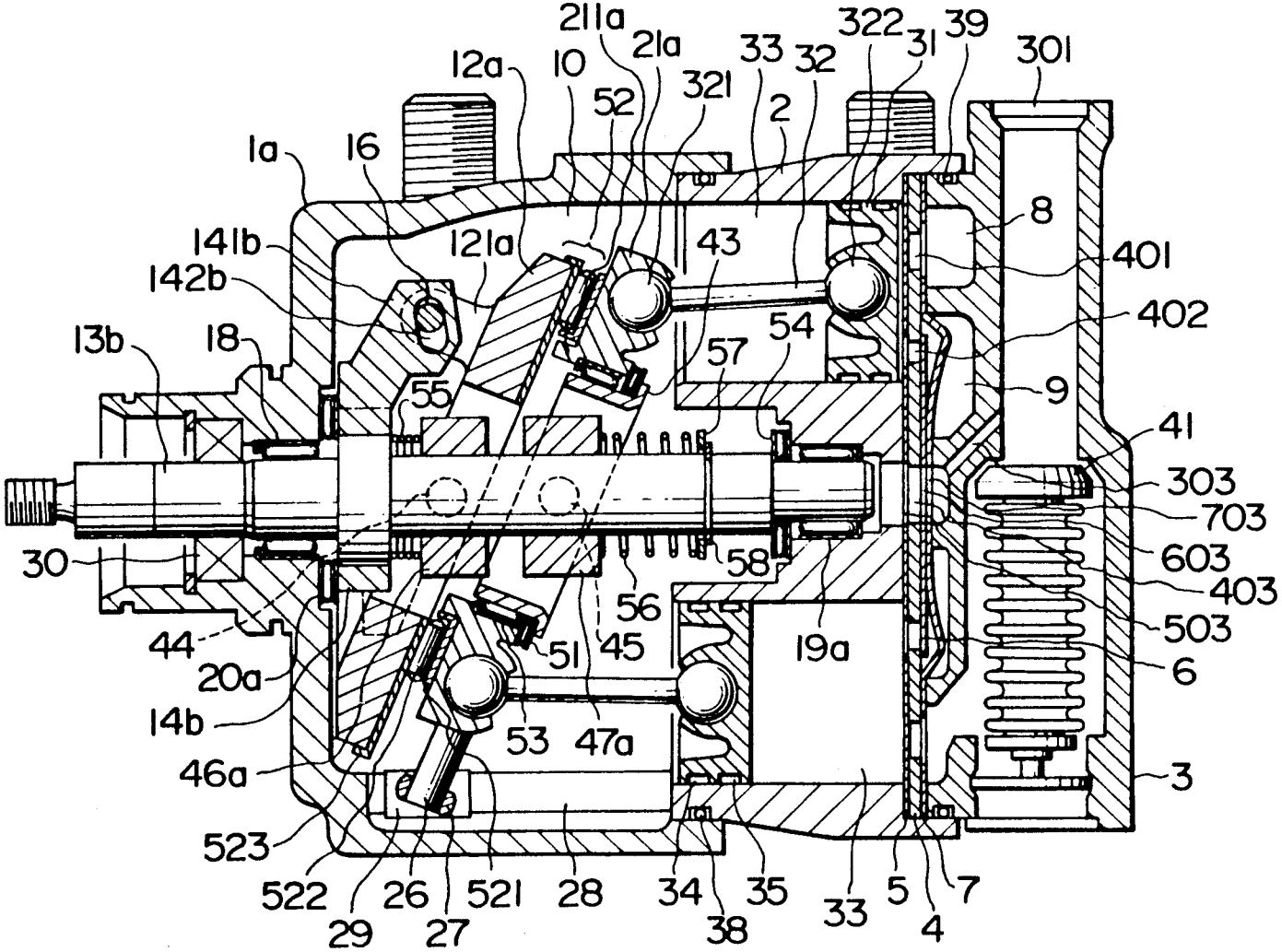
FIG. 13 is a view showing a modification of the second embodiment, in which modified sleeves are used.

This embodiment may be modified as shown in FIG. 13 in which a first sleeve 46*a* and a second sleeve 47*a* both are mounted directly on the main shaft 13*a* so as to slide along the axis of the main shaft 13*a*.

All of the above embodiments are directed to the variable-displacement wobble plate-type compressors of the type in which the pressure within the swash plate chamber is kept constant, and the pressure of the cylinder intake opening is lower than the pressure of the swash plate chamber by the control valve, thereby changing the angle of tilt of the swash plate. However, the present invention can also applied to a variable-displacement wobble plate-type compressor of the type disclosed in, for example, Japanese Patent Publication No. 4195/83, in which the pressure at a cylinder inlet is kept constant, and the pressure within a swash plate chamber is increased by a blow-by gas or the like so as to control the angle of tilt of the swash plate. In this case, similar effects can be achieved.

In the present invention, the unbalanced inertia forces such as the centrifugal forces and force couples produced in the variable-displacement wobble plate-type compressor can be greatly reduced, and. therefore advantageously the invention can provide the variable-displacement compressor which produces less vibration and noise, thus enhancing the comfort in the vehicle.

Further, since the force couples, produced by the inertia forces and tending to change the angle of tilt of the swash plate, can cancel each other, the reliability of the variable-displacement compressor can advantageously be enhanced particularly during the high-speed rotation.

What is claimed is:

1. A variable-displacement compressor comprising:

a rotatable main shaft;

pistons arranged around said main shaft;

a wobble member driven be main said main shaft in a swinging motion for reciprocating driving the pistons a first rotation member for slidably supporting said wobble member thereon;

a second rotation member arranged in slidable contact with one of said wobble member and said first rotation member;

first support means for supporting said first rotation member for rotation with said main shaft and for a tilting motion with respect to said main shaft, said first support means being disposed on an axis of rotation of said main shaft and within said first rotation member; and a second support means for supporting said second rotation member for rotation with said main shaft and for a tilting motion with respect to said main shaft, said second support means being disposed on the axis of rotation of said main shaft within said second rotation member.

2. A variable-displacement compressor according to claim 1 wherein said second support means is movable along the axis of said main shaft.

3. A variable-displacement compressor according to claim 1, further comprising a thrust bearing having a race, wherein said second rotation member comprises a swash plate arranged in slidable contact with said wobble member through said thrust bearing for swinging said wobble member, and said race has, at least in a direction which a relative sliding movement is caused between said swash plate and said wobble member when displacement of the compressor is controlled, a width at least equal to a sum of a rolling width of said thrust bearing and a maximum length of the relative sliding movement.

4. A variable-displacement compressor according to claim 1, further comprising a first sleeve mounted on said main shaft for sliding movement relative to said main shaft along the axis of said main shaft; and a second sleeve mounted on said first sleeve for sliding movement relative to said first sleeve along the axis of said main shaft, and wherein said first support means and said second support means are respectively mounted on said second sleeve and said first sleeve.

5. A variable-displacement compressor according to claim 4, further comprising preload spring means provided between said first sleeve and said second sleeve so as to urge said first and second sleeves toward each other.

6. A variable-displacement compressor according to claim 3, further comprising a first sleeve mounted on said main shaft for sliding movement relative to said main shaft along the axis of said main shaft;

a second sleeve mounted on said first sleeve along the axis of said main shaft; and wherein said first support means and said second support means are respectively mounted on said second sleeve and said first sleeve.

7. A variable-displacement compressor according to claim 1, wherein said wobble member comprises a piston support rotatable coupled to one end of said pistons, said first rotation member comprises a swash plate for swinging said piston support, and said second rotation member comprises a balance weight which is slidably connected to said swash plate in such a manner that said balance weight rotates together with said swash plate and exerts a balancing force thereon.

8. A variable-displacement compressor according to claim 1, further comprising a thrust bearing interposed between said wobble member and said second rotation member, wherein said wobble member comprises a piston support rotatably coupled to one end of said pistons, said first rotation member comprises a rotation-supporting member for said piston support, and said second rotation member comprises a swash plate for swinging said piston support, wherein said swash plate is in slidable contact with said piston support through said thrust bearing.

9. A variable-displacement compressor according to claim 8, wherein said thrust bearing includes a race, and wherein a width of said race, in at least a direction in which a relative sliding movement is caused between said swash plate and said piston support when a displacement of the compressor is controlled, is at least equal to a sum of a rolling width of said thrust bearing and a maximum length of the relative sliding movement.

10. A variable-displacement compressor comprising:

a main shaft;

pistons arranged around said main shaft;

wobble means for reciprocatingly driving said pistons;

first rotation means for slidably supporting said wobble means thereon;

second rotation means for slidably contacting one of said wobble means and said first rotation means;

means for respectively supporting said first rotation means and said second rotation means on said main shaft in such a manner that said first and second rotation means are rotatable together with said main shaft and tiltable relative to said main shaft, and wherein centers of gravity of said first and second rotation means are kept on an axis of rotation of said main shaft regardless of a tilting of said first and second rotation means.

* * * * *